US005321859A

United States Patent [19]

Buckshaw et al.

[11] Patent Number: 5,321,859

[45] Date of Patent: Jun. 21, 1994

[54] INFANT BATH CHAIR

[76] Inventors: Dennis J. Buckshaw, 42240 Crestview, Northville, Mich. 48167; James Clark, 7309 Manner Cir., #202, Westland, Mich. 48185

[21] Appl. No.: 977,012

[22] Filed: Nov. 16, 1992

[51] Int. Cl.[5] ..... A47K 3/164

[52] U.S. Cl. ..... 4/572.1; 297/467; D6/333; 4/571.1

[58] Field of Search ..... 4/572.1, 573.1, 578.1, 4/579, 585, 586, 587, 590; 295/5, 418, 467; D6/333, 344, 349, 477, 339; D23/303, 304

[56] References Cited

U.S. PATENT DOCUMENTS

| | | | |
|---|---|---|---|
| D. 195,255 | 5/1963 | Elliott | D6/339 |
| D. 261,828 | 11/1981 | Nakao et al. | D6/339 |
| D. 266,634 | 10/1982 | Knoedler et al. | D6/333 |
| 2,285,900 | 6/1942 | Chapman | 4/185 |
| 2,562,628 | 7/1951 | McPeake, Jr. | 4/572.1 |
| 2,563,076 | 8/1951 | Schreckengost | 4/185 |
| 2,985,889 | 5/1961 | Fain et al. | 4/185 |
| 3,031,229 | 4/1962 | Symbaluk | 297/390 |
| 3,209,374 | 10/1965 | Walz | 4/185 |
| 3,493,976 | 2/1970 | Baker | 4/590 |
| 4,226,467 | 10/1980 | Boudreau | 297/5 |
| 4,266,306 | 5/1981 | Lee | 4/572 |
| 5,010,606 | 4/1991 | Bernstein et al. | 4/572 |

*Primary Examiner*—Henry J. Recla
*Assistant Examiner*—Charles R. Eloshway
*Attorney, Agent, or Firm*—Krass & Young

[57] ABSTRACT

An infant bath chair adapted to be positioned in a bathtub to facilitate bathing of the infant. The chair includes a base adapted to be positioned on the bottom of the bathtub and defining a seat; a seatback having a lower end pivotally mounted on the base proximate the rear edge of the seat; a U-shaped cage having a pair of arm portion pivotally mounted at their rear ends on the base rearwardly of the seatback pivot axis and a forward bight portion embracing an infant positioned on the seat; and a latch assembly interconnecting the seatback and the cage arm portions and releasable in response to upward pivotal movement of the cage to allow adjusting pivotal movement of the seatback relative to the base. The latch assembly includes an arcuate slot on each of the arms centered on the pivot axis of the seatback and a plurality of notches positioned serially along each arcuate slot on the side of the slot remote from the seatback pivot axis and opening in the respective slot. The forward bight portion of the cage is releasably mounted on an upstanding post on the base to normally secure the cage to the base but allow release of the cage to allow pivotal movement of the cage to release the seatback latch assembly.

10 Claims, 4 Drawing Sheets 12
18
18g
10g
18b
10m
16
11
18i
10e
12i
13
12c
10
10a
22
10L
22f
10d
16a
10n
18r
10c
18j
18a
12b
12d
12c
10p
12j
12L

INFANT BATH CHAIR

BACKGROUND OF THE INVENTION

This invention relates to bath chairs and more particularly to bath chairs especially suited to facilitate bathing of an infant.

It is very difficult and dangerous to bath an infant in a regulation bathtub as the bathtub is sized to accommodate adults In an attempt to facilitate the bathing of infants various infant chairs or seats have been proposed for positioning on the bottom of the bathtub with the infant seated in the chair. None of these prior art infant bath seats have achieved any significant amount of commercial success since they have been unduly complicated and expensive and/or have failed to provide secure but adjustable positioning of the infant in the bathtub.

SUMMARY OF THE INVENTION

This invention is directed to an infant bath chair adapted to be positioned in a bathtub to facilitate bathing of the infant. According to the invention the chair includes a base adapted to be seated on the bottom of the bathtub and defining a seat, a seatback having a lower end pivotally mounted on the base proximate the rear edge of the seat, and a U-shaped cage having a pair of arms pivotally mounted at the rear ends on the base and a forward bight portion embracing an infant positioned on the seat. This arrangement provides a simple and inexpensive construction which securely and positively positions the infant in the chair.

According to a further feature of the invention, the chair further includes latch means which interconnect the seatback and the cage arm portion and which are releasable to allow adjusting pivotal movement of the seatback relative to the base. This arrangement allows the seatback to be moved between a relatively reclined position to facilitate shampooing or the like and a relatively upright position for other bathing activities.

According to a further feature of the invention, the latch means includes a plurality of notches on one of the cage arm portions and a lug on the seatback received in a respective notch and the latch means are released by pivotal movement of the cage about its pivot axis. This arrangement allows the cage to serve the dual purpose of embracing the infant in the seat and also providing the latch release for the seatback.

According to a further feature of the invention, the cage arm portions are pivoted to the base rearwardly of the pivotal connection of the lower end of the seatback to the base, the latch means includes an arcuate slot in at least one of the cage arm portions centered on the pivot axis of the seatback, and the notches are provided serially along the arcuate side of the slot remote from the seatback pivot axis and opening in the slot. With this arrangement, upward pivotal movement of the cage moves the lug out of its receiving notch and into the slot whereafter the seatback may be pivoted to bring the lug into alignment with another notch corresponding to a desired adjusted position of the seatback whereafter the cage may be lowered to position the lug in the other notch.

According to a further feature of the invention, the forward bight portion of the cage is releasably latched to the base to normally secure the cage to the base but allow release of the cage from the base to allow pivotal movement of the cage to release the seatback latch means. In the disclosed embodiment of the invention, the base includes an upstanding post positioned forwardly of the seat and the forward bight portion of the cage is releasably latched to the upper end of the post.

BRIEF DESCRIPTION OF THE PREFERRED EMBODIMENT

The invention infant bath chair, broadly considered, includes a base 10, a seatback 12, and a cage 14.

All of the seat elements are formed of a suitable plastic material such as polypropylene, preferably in an injection molding process, and all have a generally hollow U-shaped or tubular cross-sectional configuration.

Figure 8:
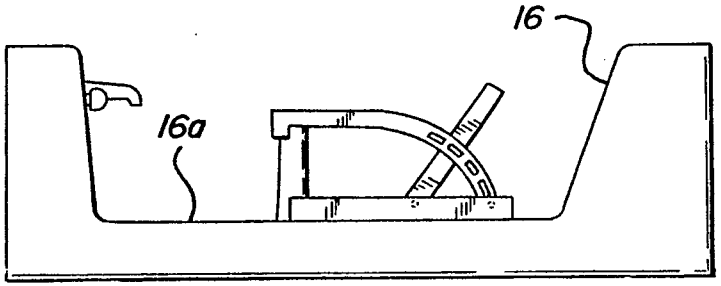
FIG. 8 illustrates the invention bath chair positioned in a bathtub.

Base 10 includes a main body portion 10*a* defining a seating surface 10*b*, a pair of parallel rearwardly extending leg portions 10*c*, and a post portion 10*d* centrally upstanding from the front end of main body portion 10*a* forwardly of seating surface 10*b*. Base 10 is generally configured such that, with the chair seated on the bottom 16*a* of a bathtub 16 as seen in FIG. 8, an infant positioned with his buttocks on the seating surface 10*b* may comfortably straddle post 10*d* with one leg on either side of the post and with the infant's feet supported on the bathtub bottom 16*a*.

A pair of opposed journals 10*e* are provided on leg portions 10*c* immediately rearwardly of the rear edge 10*f* of seating surface 10*b* and a further pair of opposed journals 10*g* are provided on leg portions 10*c* proximate the rear ends 10*h* of the leg portions. The forward wall 10*i* of post 10*d* is cut out at 10*j* to define a cantilever tongue structure 10*k* terminating in a button 101.

Figure 6:
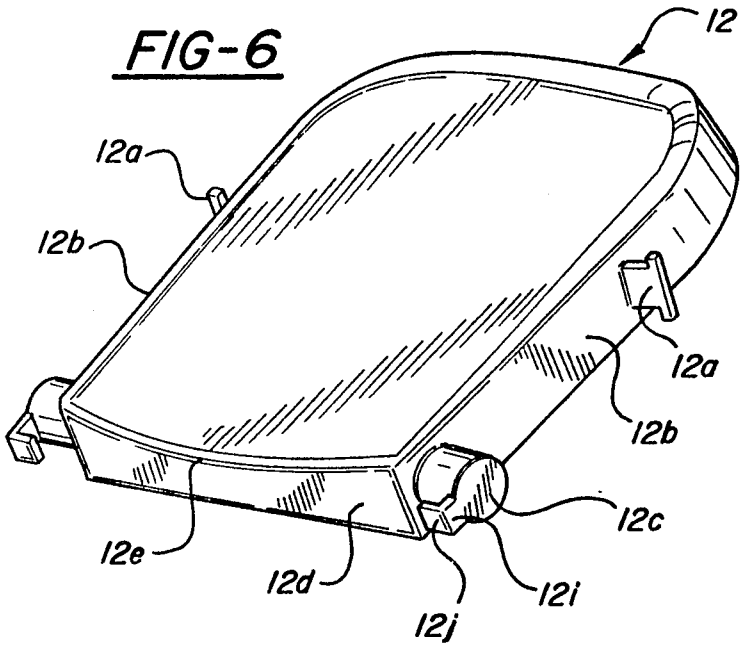
FIG. 6 is a perspective view of the seatback of the invention bath chair.
Figure 9:
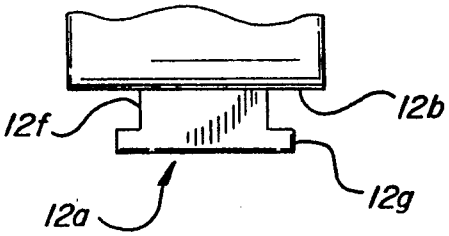
FIG. 9 is a fragmentary view of the seatback.
Figure 4:
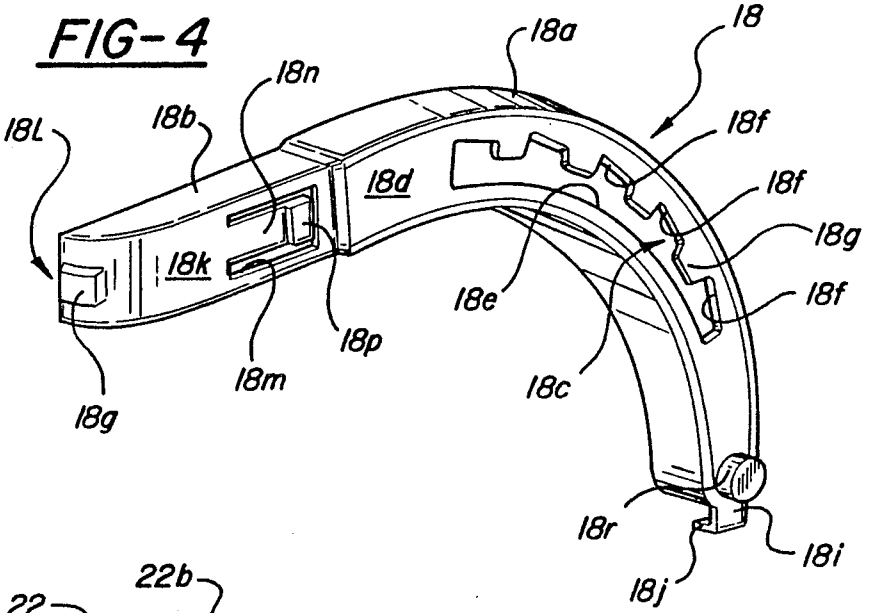
FIGS. 4 and 5 are perspective views of the elements constituting the cage of the invention bath chair.
Figure 5:
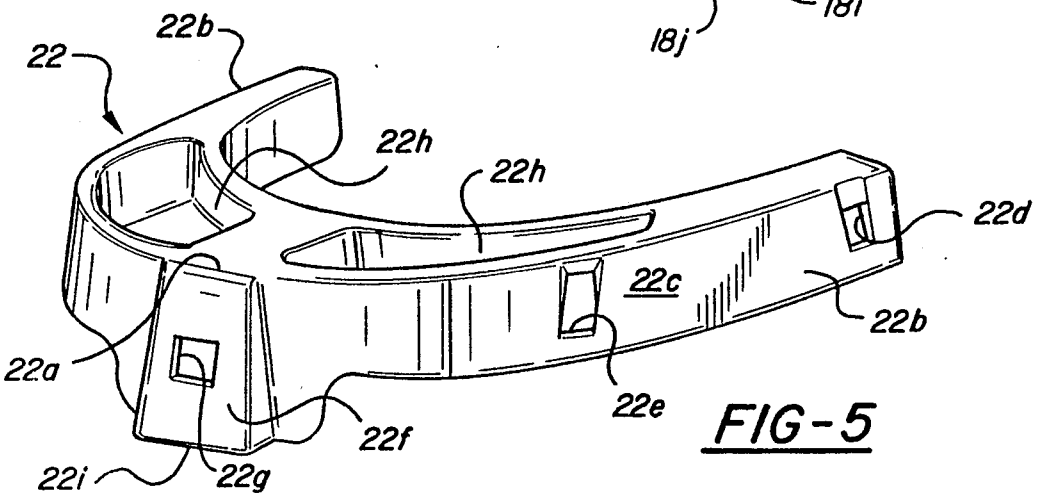
Figures 7, 11, 12, 13:
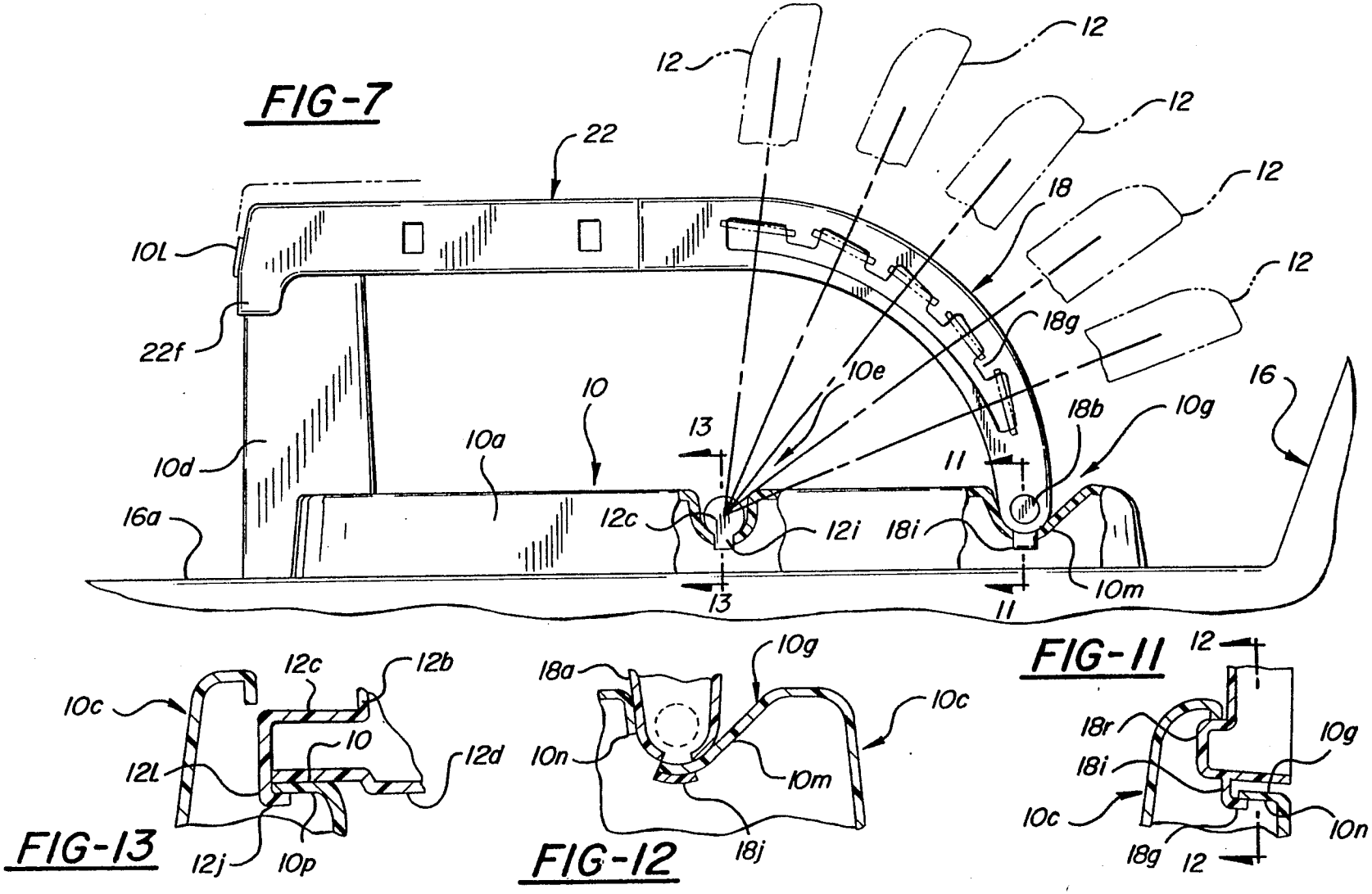
FIG. 7 is a somewhat schematic view illustrating the manner in which the seatback is moved between its various positions of adjustment.
FIG. 11 is a cross-sectional view taken on line 11—11 of FIG. 7.
FIG. 12 is a cross-sectional view taken on line 12—12 of FIG. 11.
FIG. 13 is a cross-sectional view taken on line 13—13 of FIG. 7.

Seatback 12 includes a lug 12*a* projecting laterally from each side wall 12*b* of the seatback and a trunion 12*c* projecting laterally from each side wall 12*b* of the seatback proximate the lower end 12*d* of the seatback. As best seen in FIGS. 6 and 13, trunion 12*c* includes a tab 12*i* extending downwardly from the lower arcuate portion of the trunion and including an inturned lip 12*j* for engagement beneath the portion 10*p* of the base forming the journal 10*e*. An opening 10*q* in base portion 10*p* allows the trunion to be installed in the journal without the use of tools. It will be understood that the seating of trunions 12c in journals 10e mounts the seatback for pivotal movement relative to the base. As best seen in FIG. 9, each lug 12a has a generally T-shaped configuration including a stem portion 12f and a bar portion 12g.

Cage 14 has a generally U-shaped configuration and is formed in three sections or portions including a pair of left and right arm portions 18 and a central yoke or bight portion 22.

Left and right arm portions 18 are mirror images of each other and it will be understood that the following detailed description of left arm portion 18 applies as Well to right arm portion 18.

Left arm portion 18 includes an arcuate main body portion 18a and a forward integral tenon portion 18b. Main body portion 18a includes a trunion 18r proximate the lower rear end of the main body portion sized to be pivotally received in a respective journal 10g on the base and an arcuate slot assembly 18c formed in the outboard arcuate wall 18d of the main body portion. As best seen in FIGS. 11 and 12, trunion 18r includes a tab 18i extending downwardly from the lower arcuate portion of the trunion and including an inturned lip 18j for engagement beneath the portion 10m of the base forming the journal 10g. An opening 10n in base portion 10m allows the trunion to be installed in the journal without the use of tools.

With arm portion trunions 18r received in journals 10g and seatback trunions 12c received in journals 10e, arcuate slot assembly 18c is centered on the pivot axis 24 defined by the journals 10e. Specifically, slot assembly 18c includes an arcuate main body slot 18e centered on pivot axis 24 and a plurality of notches 18f arranged serially along the arcuate side edge of slot 18e remote from axis 24 and opening in slot 18e. Each notch 18f has an arcuate dimension somewhat greater than the dimension of the stem portion 12f of a lug 12a but less than the dimension of the bar portion 12g of the lug 12a.

Tenon portion 18b extends forwardly from the forward end of main body portion 18a and its outboard wall 18k is bowed inwardly proximate the free forward end 181 of the tenon portion. A cut-out 18m in the rearward end of outboard wall 18k defines a cantilever tongue 18n terminating in a raised button formation 18p and outboard wall 18k is pressed outwardly proximate forward end 181 to define a further raised button formation 18g.

Bight or yoke portion 22 has a U-shaped configuration including a central forward portion 22a and a pair of rearwardly extending hollow arm portions 22b sized to telescopically receive arm tenon portions 18b. The outboard wall 22c of each arm portion 22b includes a rearward window 22d sized to accommodate the raised button formation 18p of a respective arm tenon portion 18b and a forward window 22e sized to accommodate the raised button formation 18g of the arm tenon portion 18b. It will be understood that left and right arms 18 are assembled to the respective arm portions 22b of the bight portion by inserting the tenon portion of the respective arm into the mortis defined by the rear hollow end of the respective bight arm portion until button formation 18g slides into window 22e and button formation 18p snaps into window 22d.

The front end of the central forward portion 22a of bight portion 22 is configured to form a hood 22f sized to fit over the upper end of post 10d and includes a window 22g sized to accommodate the button 101 defined on the upper end of post 10d. It will be understood that button 101 is snappingly received in window 22g in response to downward movement of hood 22f over the upper end of post 10d and that the cage may be released from its latching engagement with the upper end of the post by depression of button 101. A pair of trays 22h are defined in bight portion 22 to accommodate bath accessories, toys or the like.

In the assembled relation of the various parts, left and right arms 18 are snap fit into bight portion 22 to form the U-shaped cage; cage trunions 18b are fitted in journals 10g to mount the rear end of the cage on the base for pivotal movement about axis 26; trunions 12c are fitted in journals 10e to mount the lower end of the seatback for pivotal movement about pivot axis 24: the forward end of cage 14 is latched to the upper end of post 10d by the coaction of button 101 and window 22g; and the seatback 12 is held in a position of pivotal adjustment relative to the base by the coaction of lugs 12a and a respective pair of notches 18f.

Figure 1:
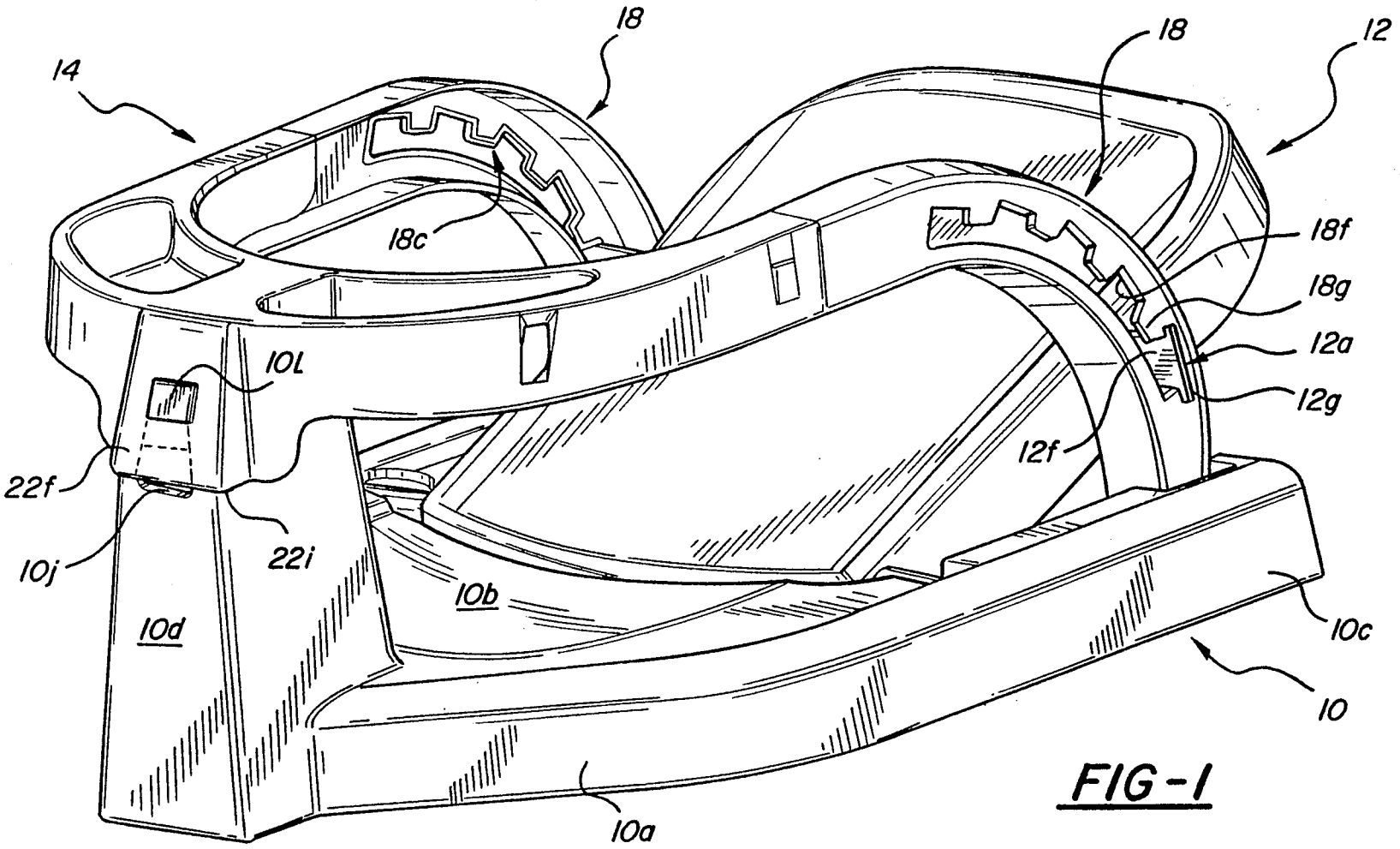
FIG. 1 is a perspective view of the invention bath chair.
Figure 3:
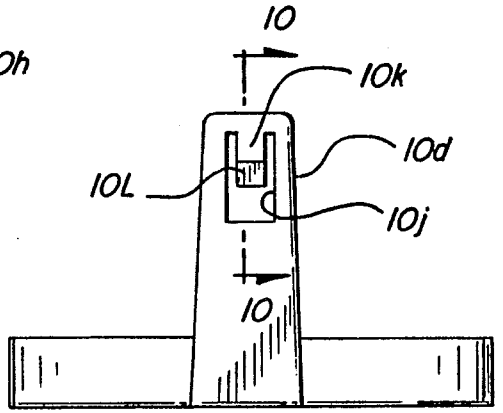
FIGS. 2 and 3 are plan and end views respectively of a base employed in the invention bath chair.
Figure 10:
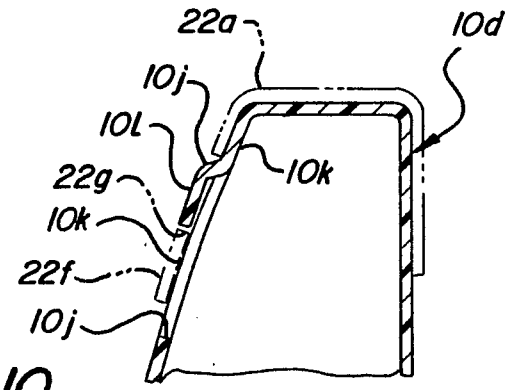
FIG. 10 is a cross-sectional view taken on line 10—10 of FIG. 3.
Figure 2:
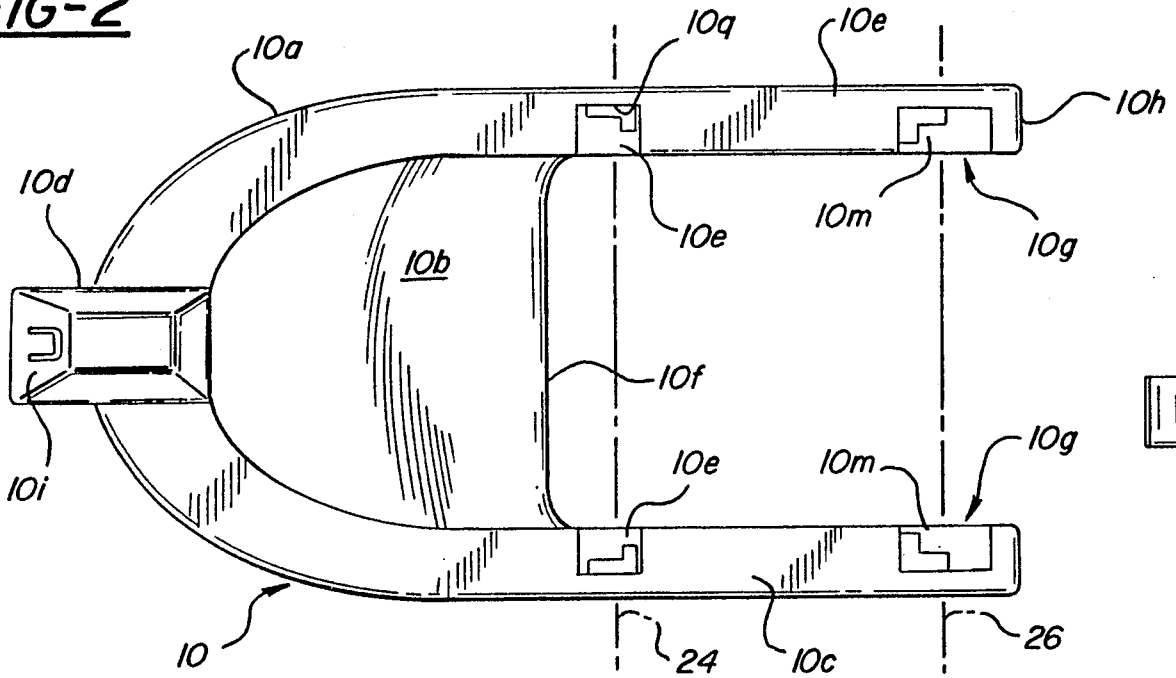

Specifically, the seatback, as best seen in FIG. 7, can be pivotally moved between a plurality of positions including, for example, a 25° position, a 40° position, a 55° position, a 70° position, and an 85° position, all as measured from the plane of the base. The five adjusted positions of the seatback are provided by the five notches 18f in each slot assembly 18c. For example, the seatback is shown in a reclined 25° position in FIG. 1 to facilitate shampooing of the infant positioned on the chair and this position is defined by receipt of lugs 12g in the notches 18f nearest the trunions 18b with the stem portion 12f of each lug passing through the respective notch 18f and the bar portion 12g of the lugs overlapping the land portions 18g defined between and around successive notches.

To change the position of adjustment of the seatback, button 101 is depressed by the supervising adult to release the cage from the upper end of the post 10d whereafter the cage may be raised slightly to the dotted line position seen in FIG. 7 to move the lugs 12a into the slot 18e whereafter the seatback 12 may be moved to a new adjusted position corresponding to another set of notches 18f. For example the seatback may be pivoted upwardly from the reclined position seen in FIG. 1 to the 70° position depicted in FIG. 7 whereafter the cage may again be lowered to latch the cage to the upper end of the post 10d and move the lug stem portions 12f into the notches 18f corresponding to the 70° position of the seatback. In actuality, as the seatback is moved to its new position following release of the cage, the cage automatically reassumes its latched position as the cage moves downwardly relative to the lug stem portions 12f on the seatback to position the lugs in the new notches. Upward pivotal movement of the cage following depression of button 101 is facilitated by positioning of the fingers of the adult in the lower end of cut-out 10j defined below the lower edge 22i of hood 22f so as to enable the user's fingers to grasp the lower edge of the hood portion 22f and apply a lifting force to the cage.

The invention bath chair will be seen to provide a simple and inexpensive construction which safely positions the infant within the chair and allows selective and ready movement of the infant between a plurality of positions to facilitate the various required bathing operations. The chair includes only five parts, all inexpensively formed of plastic in an injection molding operation, which may be readily assembled and disassembled without the use of tools.

Whereas a preferred embodiment of the invention has been illustrated in detail it will be apparent the various changes may be made in the disclosed embodiment without departing from the scope or spirit of the invention.

We claim:

1. An infant's bath chair adapted to be positioned in a bathtub to facilitate bathing of the infant characterized in that the chair includes a generally planar base adapted to be seated on a bottom of the bathtub and including an upwardly facing generally horizontal planar surface area defining a seat, a seatback having a lower end mounted for pivotal movement about a seat back axis on the base proximate a rear edge of the seat, and a U-shaped cage having a pair of arms pivotally mounted at their rear ends on the base for pivotal movement about a cage pivot axis and a forward bight portion embracing an infant positioned on the seat.

2. A chair according to claim 1 wherein said chair further includes latch means which interconnect the seatback and the cage arms and which are releasable to allow adjusting pivotal movement of the seatback about the seatback axis.

3. A chair according to claim 2 wherein said latch means includes a plurality of notches on one of said cage arms and a lug on said seatback received in one of said notches whereby said lug is disengaged from said notch by pivotal movement of said cage about its pivot axis.

4. An infant bath chair comprising:

a base adapted to be positioned on a bottom of a bathtub and defining a seat;

a seatback having a lower end pivotally mounted on the base about a seatback pivot axis proximate a rear edge of the seat;

a U-shaped cage having a pair of arm portions pivotally mounted at their rear ends on the base rearwardly of the seat back pivot axis for pivotal movement about a cage pivot axis and a forward bight portion embracing an infant positioned on the seat; and latch means interconnecting the seatback and the cage arm portions and releasable in response to upward pivotal movement of the cage to allow pivotal adjustment of the seatback relative to the base.

5. A chair according to claim 4 wherein said latch means includes an arcuate slot in each of said arm portions, said slot positioned radially from, and centered on, the pivot axis of said seatback, and a plurality of notches positioned serially along each arcuate slot on a side of the slot remote from the seatback pivot axis.

6. A chair according to claim 5 wherein the forward bight portion of said cage is releasably mounted to said base to normally secure the cage to the base but allow release of the cage from the base to allow pivotal movement of the cage to release the latch means.

7. A chair according to claim 6 wherein said base includes an upstanding post positioned forwardly of, and connected to, said seat and said forward bight portion of said cage is releasably latched to an upper end of said post.

8. An infant's bath chair adapted to be positioned in a bathtub to facilitate bath of the infant characterized in that the chair includes a base adapted to be seated on a bottom of the bathtub and defining a seat, a seatback having a lower end pivotally mounted on the base proximate a rear edge of the seat, a U-shaped cage having a pair of arms pivotally mounted at their rear ends on the base and a forward bight portion embracing an infant positioned on the seat, latch means which interconnect the seatback and the cage arm portions and which are releasable to allow adjusting pivotal movement of the seatback relative to the base, the latch means including a plurality of notches on one of said cage arm portions and a lug on said seatback received in a respective notch, said latch means being released by pivotal movement of said cage about its pivot axis, said cage arm portions being pivoted to the base rearwardly of the pivotal connection of the lower end of the seatback to the base, said latch means including an arcuate slot in said one cage arm portion, said slot being positioned radially from, and centered on, the pivot axis of said seatback, and said notches being provided serially along an arcuate side of said slot remote from said seatback pivot axis whereby upward pivotal movement of said cage moves said lug out of its receiving notch and into said slot whereafter said seatback may be pivoted to bring said lug into alignment with another notch corresponding to a desired adjusted position of the seatback whereafter the cage may be lowered to position the lug in the other notch.

9. An infant's bath chair adapted to be positioned in a bathtub to facilitate bathing of the infant characterized in that the chair includes a base adapted to be seated on a bottom of the bathtub and defining a seat, a seatback having a lower end pivotally mounted on the base proximate a rear edge of the seat, a U-shaped cage having a pair of arms pivotally mounted at their rear ends on the base and a forward bight portion embracing an infant positioned on the seat, and latch means which interconnect the seatback and the cage arm portions and which are releasable to allow adjusting pivotal movement of the seatback relative to the base, the latch means including a plurality of notches on one of said cage arm portions, a lug on said seatback received in a respective notch, a latch means being released by pivotal movement of said cage about its pivot axis, the forward bight portion of said cage being releasably latched to said base to normally secure the cage to the base but allow release of the cage from the base to allow pivotal movement of the cage to release the latch means.

10. A chair according to claim 9 wherein said base includes a centrally upstanding post positioned forwardly of said seat and said forward bight portion of said cage is releasably latched to an upper end of said post.

* * * * *